United States Patent [19]

Sweger

[11] 4,076,290

[45] Feb. 28, 1978

[54] HATCH COVER LOCKING MEANS

[75] Inventor: Theodore J. Sweger, Lake Worth, Fla.

[73] Assignee: Illinois Railway Equipment Co., Chicago, Ill.

[21] Appl. No.: 668,465

[22] Filed: Mar. 19, 1976

[51] Int. Cl.[2] ..... E05C 3/04

[52] U.S. Cl. ..... 292/256.5

[58] Field of Search ..... 292/256.5, 257, 210, 292/247, 246; 105/377

[56] References Cited

U.S. PATENT DOCUMENTS

| | | | |
|---|---|---|---|
| 1,117,643 | 11/1914 | Dommer | 292/257 X |
| 2,559,681 | 7/1951 | Senseman | 292/247 X |
| 3,804,026 | 4/1974 | McNally | 292/210 |

*Primary Examiner*—Richard E. Moore

*Attorney, Agent, or Firm*—Lockwood, Dewey, Zickert & Alex

[57] ABSTRACT

A lock-down assembly for a hinged hatch cover having a lock strap with an arm portion projecting laterally over a hopper car roof on the side of the hatchway opposite the hatch cover hinge. An operating lever is pivotally mounted adjacent to one end between the upstanding sides of a bifurcated support mounted on the roof adjacent to one side of the projecting arm of the lock strap when the hatch cover is closed. The underside of the lever presses down on the arm with the handle of the lever extending in the fore-and-aft direction above the car roof. A clevis or shackle is pivotally mounted on the upper ends of the upstanding sides of the bifurcated support. The pivoted end of the lever opposite the handle portion has a hook formation under which the bight of the clevis or shackle has hooked engagement when the lever is in its locking position. The lever is released by pressing down on the handle to raise the hook formation sufficiently to allow the clevis to be turned up out of hooking engagement.

2 Claims, 7 Drawing Figures

10
11
16
17
18
20
22
25
31
33
34
35
36
37
3
4

HATCH COVER LOCKING MEANS

This invention relates to new and improved locking means particularly suited for locking hatch covers of railway hopper cars of the type having in their roofs longitudinally extending upstanding hatchways or trough hatches. Hatch cover locking means of this general type for hopper cars are disclosed in prior art patents including, Jensen and Nadherny U.S. Pat. No. 3,848,912 issued Nov. 19, 1974 and McNally U.S. Pat. No. 3,804,026 issued Apr. 16, 1974. These prior hatch cover locking means utilized elongated operating lever which were pivoted adjacent one end on a suitable support mounted on the roof structure of the hopper car. On being turned or pivoted into their locking positions the operating levers, or parts carried thereby, of these prior constructions engaged laterally projecting press-down arms or locking extensions provided by the latch straps mounted on the hinged hatch covers so as to press down on such extensions or arms and thereby secure the hatch covers in their closed or locked positions. Releaseable retention or catch means were provided in these prior structures for securing the operating handle in its closed or locked position.

The object of the present invention, generally stated, is the provision of new and improved locking means for hatch covers for hopper cars or the like having a simplified construction and fewer parts than the lock means of the prior art thereby reducing cost while achieving equal or better performance and ease of manipulation.

Certain other objects of the invention will become apparent to those skilled in the art from the following detailed description of a preferred embodiment thereof taken in connection with the accompanying drawings, wherein.

Figures 2, 4, 5:
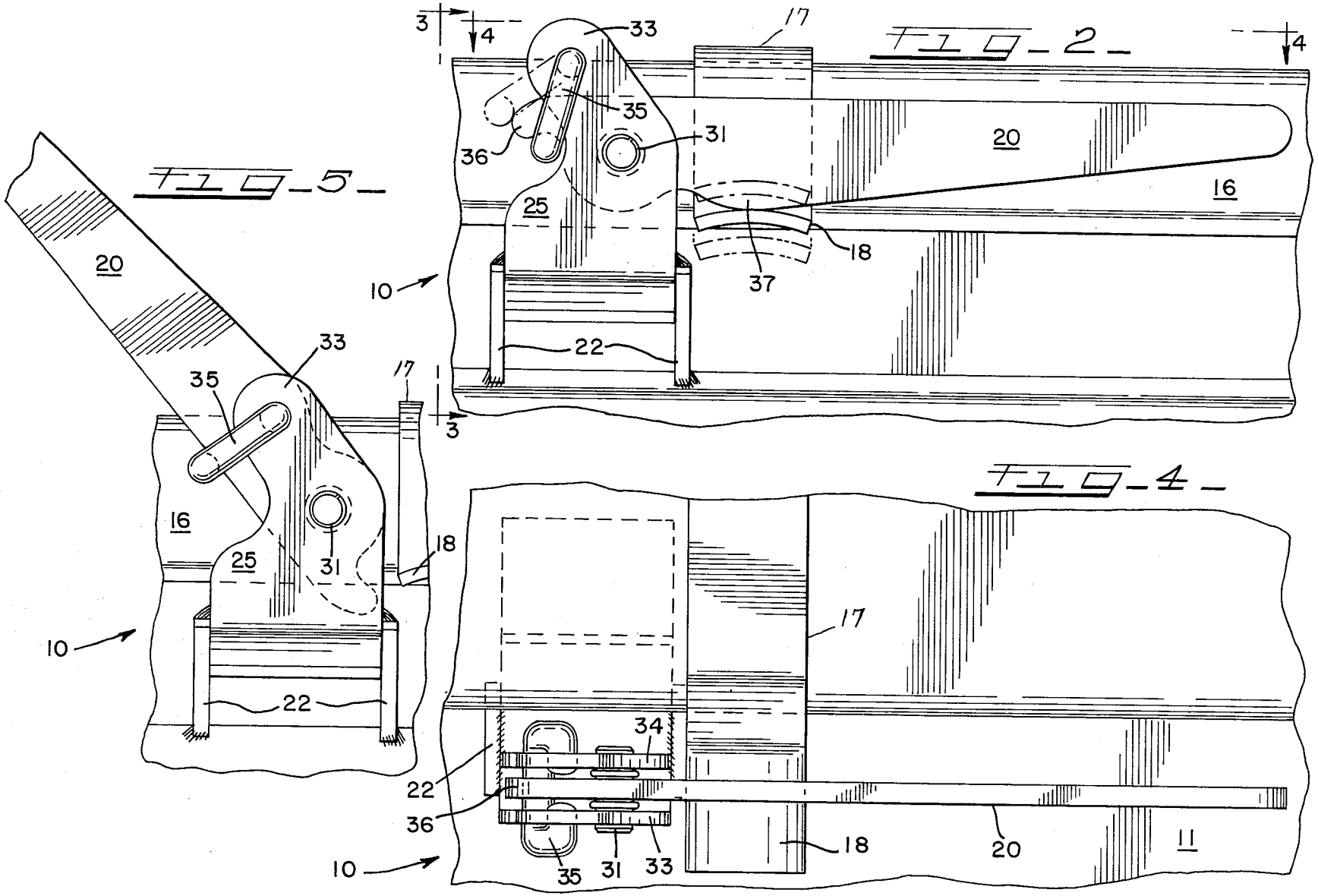
FIG. 2 is a side elevational view of the hatch cover lock-down assembly as shown in FIG. 1.
FIG. 4 is a top plan view of the assembly taken on line 4—4 of FIG. 2.
FIG. 5 is a fragmentary side elevational view showing the lock-down assembly of FIG. 1 in the fully open or released position.
Figure 6:
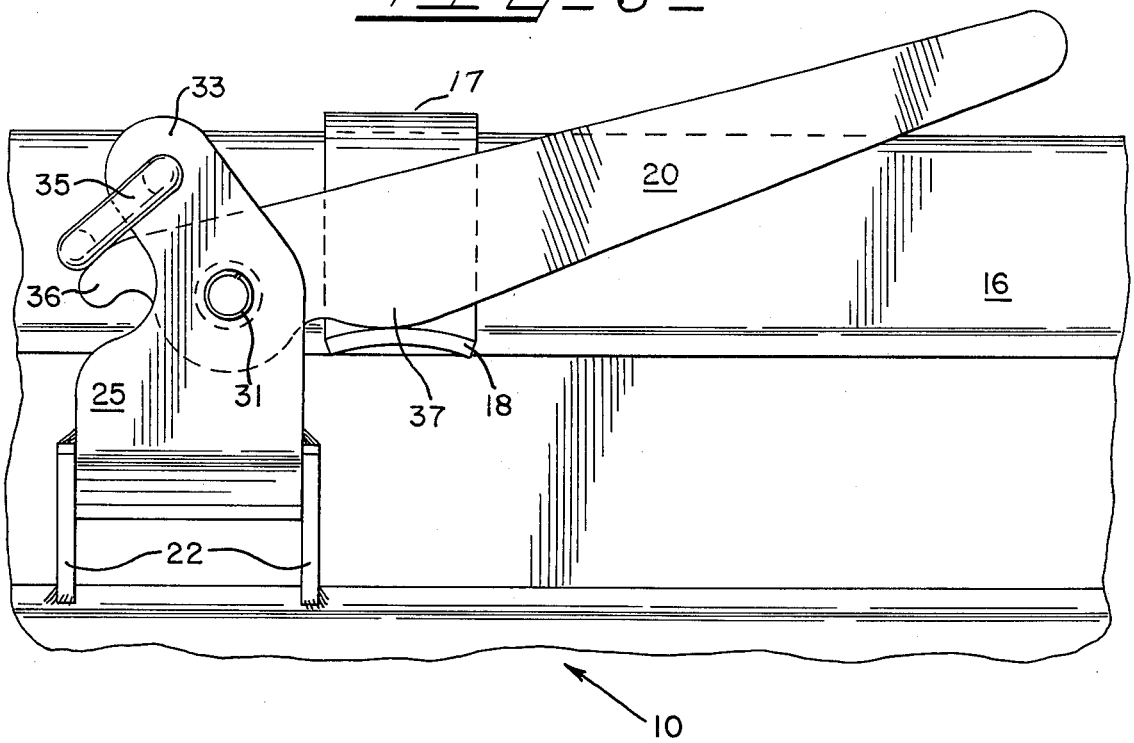
Figure 7:
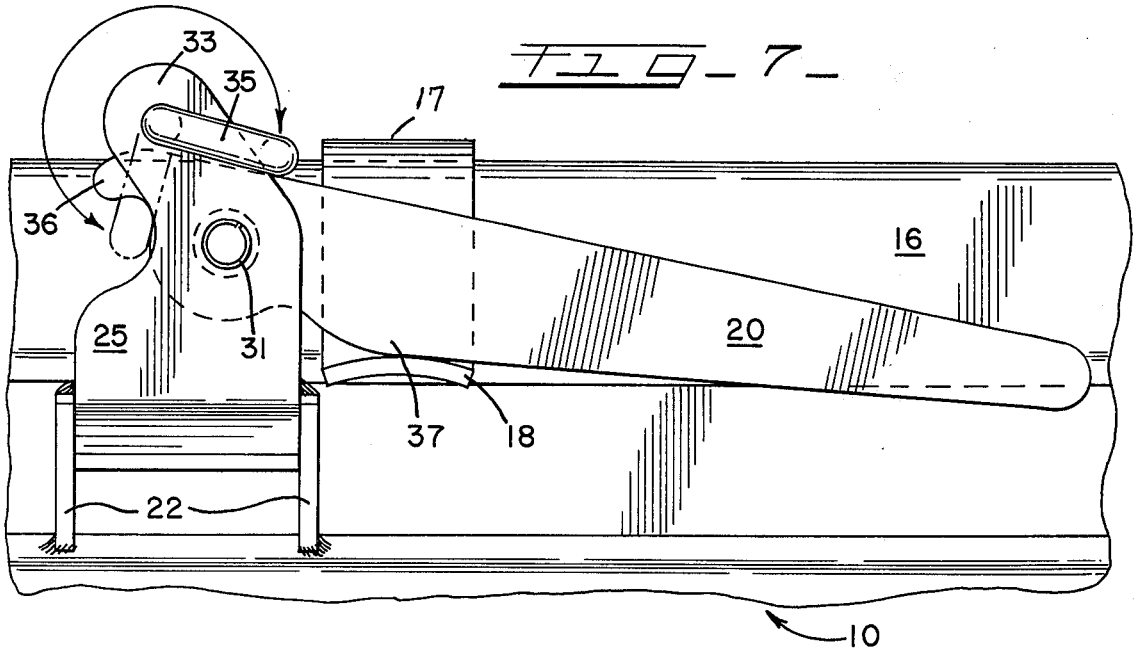

FIG. 6 is a side elevational view similar to FIG. 2 but showing the lock-down assembly in the unlocked condition with the manual operating lever resting on the laterally projecting press-down arm or locking extension of the locking strap; and FIG. 7 is another side elevational view similar to FIG. 2 but showing the operating parts in the position they occupy when the manual operating lever is fully depressed and ready to be either locked down or released depending upon the position into which the clevis or shackle is turned.

Figure 1:
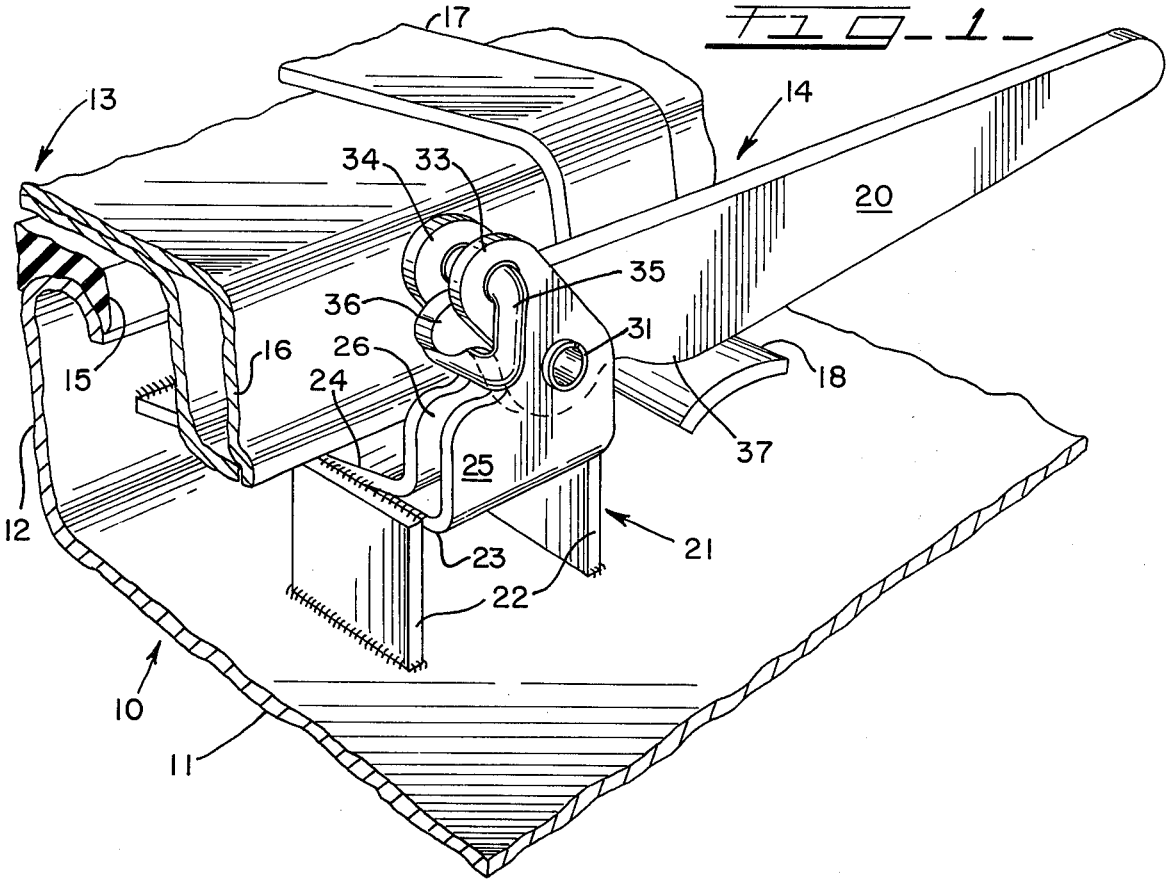
FIG. 1 is a fragmentary perspective view of a hatch cover lock-down assembly embodying the present invention and showing the parts in the relationship which they occupy when the hatch cover is locked down or latched in its closed position over a hatchway or trough in the roof of a railway hopper car.

Referring to FIG. 1, the roof structure of a trough hatch hopper car is indicated generally at 10 with the roof or roof sheet being indicated at 11 and having integral therewith, parallel, upstanding and longitudinally extending, coaming portions 12 (one shown) which provide the sides of the upstanding hatchway or trough hatch in the roof structure 10. This roof structure including the hatchway or trough hatch is of known type as is also the hatch cover which is indicated generally at 13. The lock-down assembly of this invention for securing the hatch cover 13 in its lock down or latched condition is indicated generally at 14 adjacent the side of the hatch cover 13 opposite from the hinged side (not shown). On its underside the hatch cover 13 carries a longitudinally extending gasket 15 formed of resilient rubber-like material of known type. In the particular construction shown the hatch cover 13 also includes a latch or locking strap support 16 embracing the adjacent corner of the hatch cover in known manner and providing a support for a conventional latch or locking strap 17 having a laterally extending or projecting press-down arm or portion 18.

The structure thus far described may be considered to generally follow or correspond to prior art hatch cover structures. Referring now more particularly to the details of the lock-down assembly 14, this comprises an elongated manual operating lever 20 which is pivotally mounted adjacent one end on an upstanding support structure mounted on the roof sheet 11 and indicated generally at 21. The upstanding support 21 comprises a pair of spaced supports 22—22 welded or otherwise suitably secured in a parallel upstanding position on the roof 11. The supports 22 have mounted thereon between their upper edges a pair of angle members 23 and 24 each of which includes a correspondingly shaped vertical leg 25 and 26, respectively. Together these vertical legs 25 and 26 provide a bifurcated support for the pivoted end of the lever 20.

The angle member 23 has a generally laterally extending lower leg portion 27 (FIG. 3) which is suitably secured, as by welding, between the upper edges of the spaced side supports 22—22. The leg 27 includes a downwardly inclined distal portion 28 on which is secured as by welding the lower leg 30 of the cooperating angle member 24. The distal end of the lower leg member 30 is welded or otherwise secured to the adjacent coaming 12 of the trough hatch or hatchway.

Figure 3:
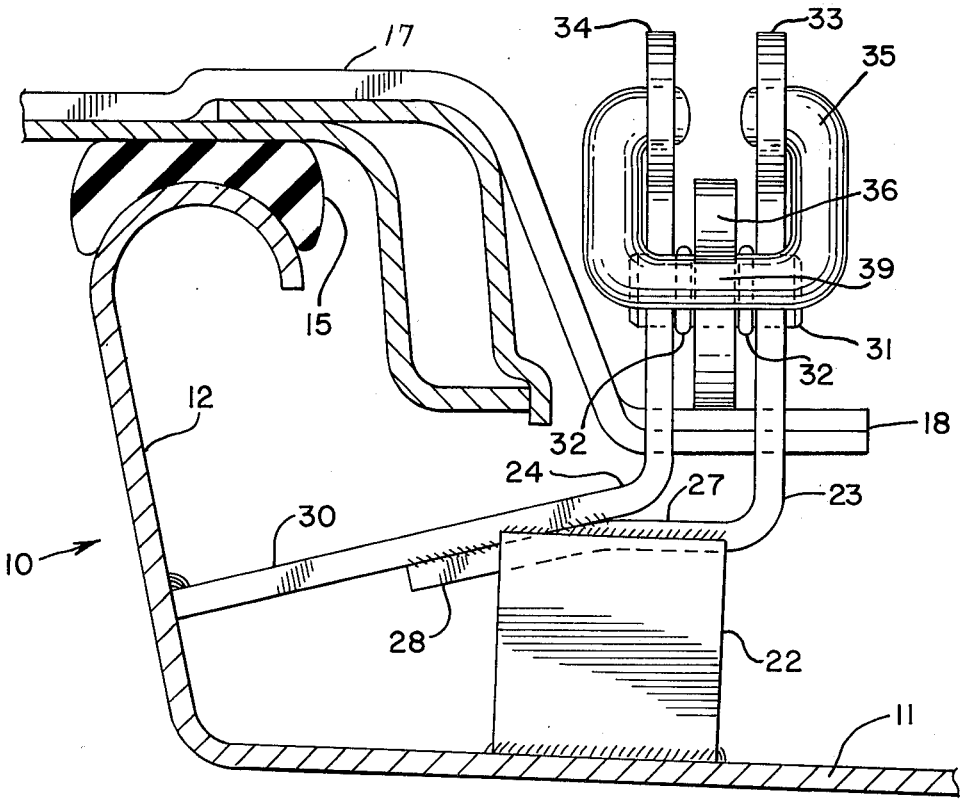
FIG. 3 is an end elevational view of the assembly taken on line 3—3 of FIG. 2.

The vertical legs 25 and 26, as well as the pivoted end of the lever 20, are suitably apertured for receiving therethrough a roll pin 31. The lever 20 is held in place mid-way between the legs 25 and 26 by retaining spacer rings 32—32 (FIG. 3). The parallel legs 25 and 26 of the bifurcated support have inclined upper end portions 33 and 34, respectively, which are provided with registering apertues for receiving the inturned ends of a clevis or shackle 35. It will be seen that the shackle or clevis 35 when not restrained, may be pivoted or turned from its downwardly hanging position. The bight 39 of the clevis or shackle 35 is adapted to have hooked retaining engagement with a hook formation 36 on the pivoted end of the lever 20. The underside or bottom edge portion of the operating lever 20 which engages the top side of the press-down arm or extension 18 is indicated at 37, being at the deepest portion of the lever.

The manner in which the lock-down assembly 14 operates will now be described with reference to the drawings. In FIGS. 1–3 the lock-down assembly 14 is shown in its fully locked down or latched condition securely locking down the hatch cover 13 on the hatchway or hatch trough with the gasket 15 being held in a compressed condition. The clevis or shackle 35 is in its fully turned down position and its bight 39 has hooking or retaining engagement under the hook formation 36. It will be appreciated that the arm or extension 18 of the locking strap 17 is biased upwardly against the restrained underside and engaging portion 37 of the operating lever 20 by reason of the compressed condition of the gasket 15. Accordingly, the assembly is held and retained in this fully locked condition and it requires positive manipulation of the lever 20 and shackle or clevis 35 in order to effect the release or unlocking thereof. When the handle is forced down against the force of the compressed gasket 15, the handle has the lowered position shown in FIG. 7 while the hook 36 on the pivoted end has the raised position shown therein. In the raised position of the hook 36 the clevis 35 is free to be turned clockwise out of engagement with the hook as shown in solid line in FIG. 7. The handle 20 is now free to be rotated upwardly to its full open position shown in FIG. 5 and out of the path of the press-down arm 18.

On latching or locking the locking assembly 14, the hatch cover 13 is lowered to the closed position and handle 20 is rotated clockwise from the position shown in FIG. 5 to the position shown in FIG. 6. The clevis 35 is rotated counter-clockwise onto the top of the hook 36. Now, the handle 20 is pressed down against the force of the gasket 15 to its lowermost position shown in FIG. 7 allowing the clevis 35 to swing underneath the hook. On releasing the downward force on the handle, the bight 39 engages and becomes hooked underneath the hook 36 wherein it remains until intentionally released.

What is claimed as new is:

1. In lock means for locking down in its closed position over an upstanding hatchway in the roof of a hopper car a hatch cover that is hinged at one side of said hatchway, said lock means having, a lock strap mounted on said hatch cover and a press-down arm projecting laterally over said roof on the side of the hatchway opposite said hinged side of said hatch cover when the latter is in its closed position, an upstanding bifurcated support for an operating lever mounted on said roof adjacent one side of said press-down arm when said latch cover is closed, and an operating lever pivotally mounted between the sides of said bifurcated support in such manner that in the locked position the underside of said lever presses down on said press-down arm and the handle portion of said lever extends in spaced relationship over said roof, the improvement comprising, the upper end of said bifurcated support projecting above the pivot axis of said lever, a clevis pivotally mounted on said upper end of said bifurcated support, and the end of said lever opposite said handle end having a hook formation thereon projecting through said clevis and engaging the bight thereof when said clevis is turned down and said lever is in the locked position, said lever being released from its locked position by pressing down on said handle thereof thereby simultaneously raising said hook formation sufficiently to allow said clevis to be turned up and thereby released from hooking engagement under said hook.

2. In the lock means and improvement called for in claim 1 said upstanding bifurcated support comprising a pair of spaced parallel upstanding support plates mounted on the roof or deck and a pair of angle members with laterally extending lower legs and spaced parallel vertical legs with the upper end portions thereof inclined away from said handle portion of said operating lever, the lower leg of one of said angle members being connected to the upper edges of said support plates and the lower leg of the other of said angle members being mounted on the first mentioned lower leg and having its distal end being connected to the adjacent side of said hatchway.

* * * * *